US006253565B1

(12) United States Patent
Arledge

(10) Patent No.: US 6,253,565 B1
(45) Date of Patent: Jul. 3, 2001

(54) $H_20$ MIST KIT AND METHOD FOR HOME EXTERNAL CONDENSER UNITS

(76) Inventor: Clifford H. Arledge, 324 Larbro Rd., Savanah, GA (US) 31410

( * ) Notice: Subject to any disclaimer, the term of this patent is extended or adjusted under 35 U.S.C. 154(b) by 0 days.

(21) Appl. No.: 09/453,493

(22) Filed: Dec. 3, 1999

Related U.S. Application Data

(60) Provisional application No. 60/111,275, filed on Dec. 7, 1998.

(51) Int. Cl.[7] ..... F28D 5/00

(52) U.S. Cl. ..... 62/305; 62/171; 62/91

(58) Field of Search ..... 62/305, 304, 171, 62/183, 506, 91; 137/79

(56) References Cited

U.S. PATENT DOCUMENTS

| | | | | |
|---|---|---|---|---|
| 2,278,242 | | 3/1942 | Chapman | 275/2 |
| 4,028,906 | * | 6/1977 | Gingold et al. | 62/183 |
| 4,170,117 | | 10/1979 | Faxon | 62/183 |
| 4,193,269 | * | 3/1980 | Barry | 62/171 |
| 4,240,265 | * | 12/1980 | Faxon | 62/171 |
| 4,266,406 | * | 5/1981 | Ellis | 62/183 |
| 4,274,266 | | 6/1981 | Shires | 62/171 |
| 4,542,627 | | 9/1985 | Welker | 62/171 |
| 4,576,012 | * | 3/1986 | Luzenberg | 62/305 X |
| 4,685,308 | | 8/1987 | Welker | 62/171 |
| 5,003,789 | | 4/1991 | Gaona | 62/304 |
| 5,074,124 | * | 12/1991 | Chapman | 62/305 |
| 5,117,644 | | 6/1992 | Fought | 62/171 |
| 5,285,651 | | 2/1994 | Marine | 62/171 |
| 5,311,747 | | 5/1994 | Pringle et al. | 62/183 |
| 5,605,052 | * | 2/1997 | Middleton et al. | 62/171 |
| 5,701,748 | * | 12/1997 | Phelps et al. | 62/305 X |
| 5,950,445 | * | 9/1999 | Wang | 62/305 X |
| 6,006,538 | * | 12/1999 | Prueitt | 62/305 X |

* cited by examiner

*Primary Examiner*—Michael Powell Buiz
*Assistant Examiner*—Chen-Wen Jiang
(74) *Attorney, Agent, or Firm*—Jim Zegeer

(57) ABSTRACT

The efficiency of home external condenser units is improved by cooling ambient air by a water mist, preferably formed about 12 inches away from the condenser unit. Mist-forming nozzles or heads are mounted on the condenser unit housing and coupled to a water supply (spigot) via a solenoid valve coupled to the thermostat control circuit for the condenser unit.

3 Claims, 5 Drawing Sheets

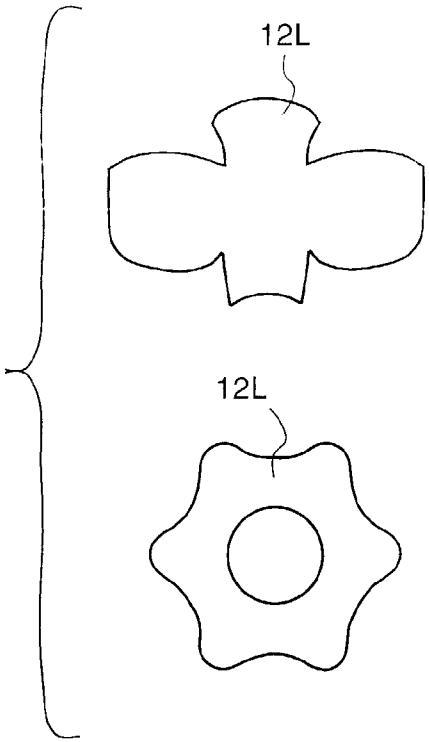
FIG. 3C
FIG. 3B
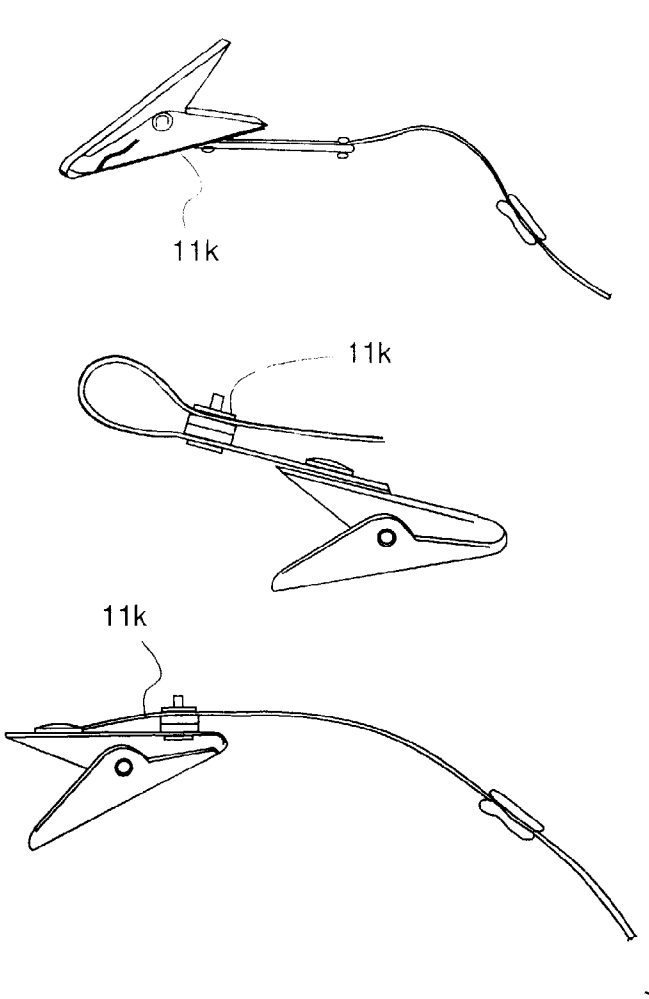

$H_20$ MIST KIT AND METHOD FOR HOME EXTERNAL CONDENSER UNITS

REFERENCE TO RELATED APPLICATION

This application is based on my provisional application Ser. No. 60/111,275 filed Dec. 7, 1998 entitled $H_20$ MIST KIT FOR HOME EXTERNAL CONDENSER UNITS.

BACKGROUND AND BRIEF DESCRIPTION OF THE INVENTION

Residential or home air conditioners include an external condenser unit having a coil wherein a refrigerant is circulated through the coil for heat exchange purposes. During operation, the coils are cooled by a fan which draws external air over the condenser coil.

There have been numerous attempts in the past to use water to cool condenser coils to thereby enhance the efficiency. See the following patents:

| Patent No. | Inventor and Title |
|---|---|
| 2,278,242 | Chapman<br>For: EVAPORATIVE COOLER |
| 4,028,906 | Gingold et al<br>For: FOGGING DEVICE FOR COOLING A CONDENSER COIL |
| 4,170,117 | Faxon<br>For: MIST SPRAY APPARATUS FOR AIR CONDITIONER CONDENSER |
| 4,240,265 | Faxon<br>For: MIST SPRAY APPARATUS FOR AIR CONDITIONER CONDENSER |
| 4,274,266 | Shires<br>For: WATER COOLING SYSTEM FOR AIR COOLED AIR CONDITIONERS |
| 5,003,789 | Gaona<br>For: MIST AIR CONDITIONER FOR EVAPORATIVE COOLER |
| 4,542,627 | Welker<br>For: COOLING APPARATUS FOR AIR CONDITIONER AND REFRIGERATION SYSTEMS |
| 4,685,308 | Welker<br>For: TEMPERATURE RESPONSIVE COOLING APPARATUS |
| 5,117,644 | Fought<br>For: CONDENSER COIL COOLING APPARATUS |
| 5,285,651 | Marine<br>For: AIR CONDITIONER COOLING APPARATUS |
| 5,311,747 | Pringle et al<br>For: WATER-ASSISTED CONDENSER COOLER |
| 5,605,052 | Middleton et al<br>For: MIST SPRAY SYSTEM FOR REFRIGERATION CONDENSERS |

For the most part, these units are not satisfactory because some unduly block airflow and/or they tend to cause excessive rusting of the condenser coils and the associated hardware in the external condenser unit.

The object of this invention is to provide an improved method and apparatus for misting home external condenser units which does not cause excessive rusting and is more efficient and less costly and is easy to install.

According to the present invention, a fine spray mist is formed in the airflow stream about twelve inches up-stream or spaced away from the condenser unit so as to cool the air being drawn into the condenser unit. This cooled air allows the fluid in the condensing unit to change state much easier and faster. On very hot summer days, the present invention removes some super heat from the air and lowers the suction pressure; for instance, by removing this extreme heat when the temperature is in the high 90's and the heat index is 110° or above. The flash gases returning on the suction side of the condenser can condense back to liquid form much easier thus lowering the current drawn by the condensing unit and the air conditioning unit plus reduce running time on the condensing unit and also on days which have extreme heat will allow the unit to cycle on and off in synchronism with the thermostat.

Moreover, by making the water spray in the form of a mist, less water is required because of the size of the spray heads and this is the only time the water is being used, e.g. when the thermostat calls for cooling. Because the water is in the form of a cloud or mist, there is less tendency for water to collect in the condenser unit so that the condenser unit does not rust out. In other words, no pool of water or water droplets are retained within the condensing unit.

If the heating unit has a heat pump and underground wiring going to a coil on the solenoid valve, for installation unscrew the water line at the spigot where the water supply was picked up and attach the one-quarter inch outside dimension plastic tubing. Before starting up in the spring, it is preferable that the spray orifice be washed in warm soapy or soda water to remove encrustation and the like and then rub a little Vaseline® (petroleum jelly) on the rubber orifice and screw them back into the three tees. Hook up the ground wire and this prepares the unit to be ready for next Spring.

It must be remembered that the invention is not sucking or drawing water through the condensing unit. The mist generated by the spray orifices just cools the air down to make the heat exchange process more efficient, and this is the process which makes the unit operate exceptionally well.

DESCRIPTION OF THE DRAWINGS

The above and other objects, advantages and features of the invention will become more clear when considered with the following specification and accompanying drawings, wherein:

FIGS. 3A–3K are pictorial depictions of component parts of the invention.

DETAILED DESCRIPTION OF THE INVENTION

Figure 1:
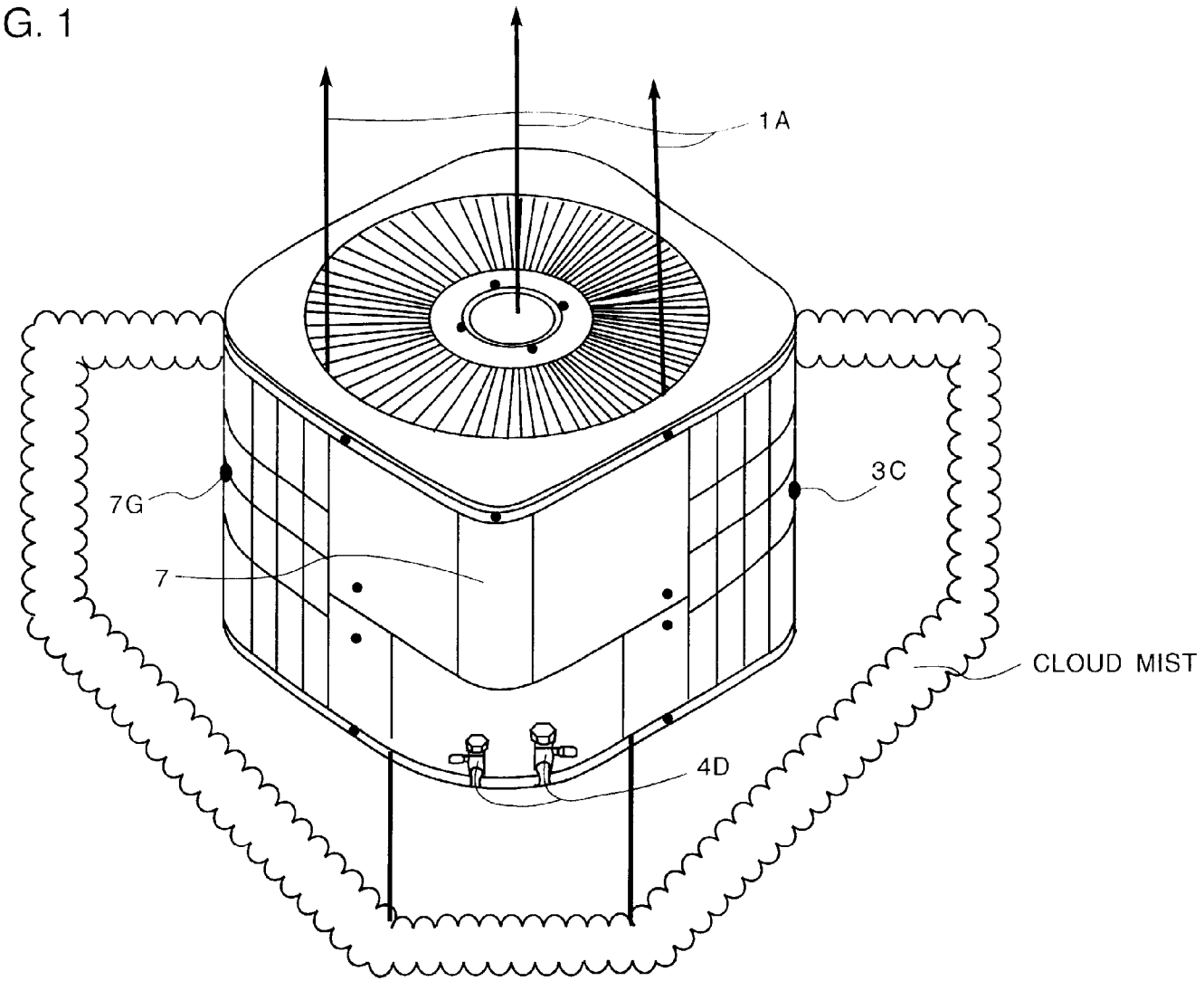
FIG. 1 is an isometric perspective view of a home external condensing unit incorporating the invention.
Figure 2:
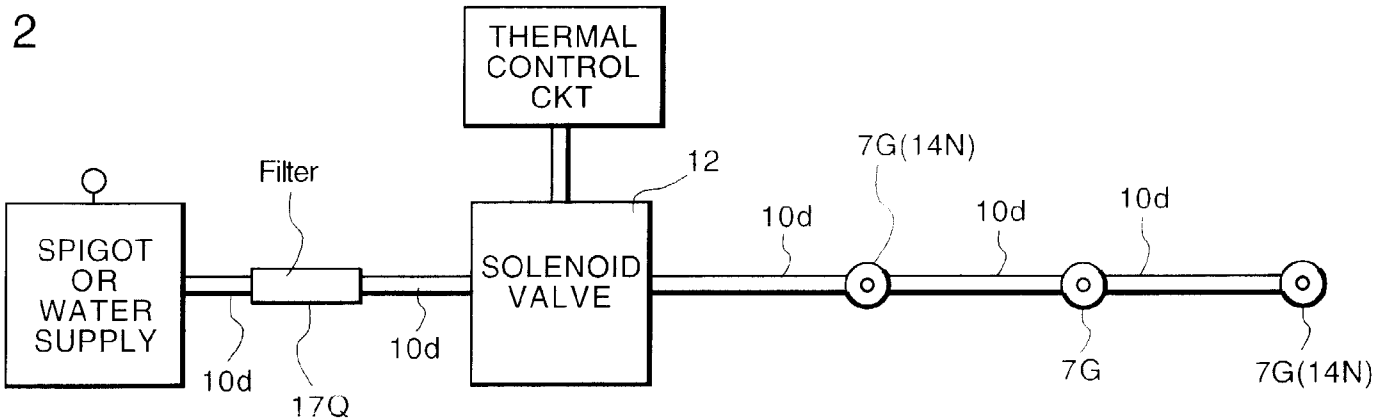
FIG. 2 is a functional block diagram of the misting system shown in FIG. 1.

The basic objective of the invention is to improve the efficiency of home air-conditioning external condensing units by cooling the air drawn through the unit. As shown in FIG. 2, a source of water, such as an outside spigot 10 has a fitment 11 attached to serve as the source of water. Plastic tubing (¼") connects the source of water to a solenoid valve 12 which has an operating coil 12OC which is electrically connected with thermostat controls in the house by way of the service panel on the external condenser (see FIG. 1). An in-line filter (see FIG. 3H) may be included in the water line to the valve 12. The water from valve 12 is coupled by ¼" tubing to a plurality of mist forming nozzles 15. As shown in FIG. 1, the air cooling mist is formed about twelve inches away from or upstream of the condensing unit and cools the air prior to the air entering the condensing unit.

All the items that come with the $H_2O$ Kit for the user to hook up and be ready in about 30 minutes are as follows:

1. At least three spray orifices.
2. Twenty-five foot roll of ¼" outside dimension plastic tubing.

3. Three plastic tees.

4. Three clamps for mounting water line as shown.

5. Water solenoid with ferrule shown on illustration (18) V-sealed unit.

6. 115 V sealed coil.

7. A diagram on "How to Install Complete Kit".

Also in kit will show the owner where to place plastic tees that mount the spray heads and orifices and end cap as needed.

Part Number Function

1A Air that has passed through the condensing unit.

2B Air that has passed through the cloud created by installing the invention ($H_2O$ mist kit). Air now has dropped from about 115° F. on heat index to about 85° F.

3C This band runs around all three sides of the condenser.

4D This panel is removed for installing #18V checking freon pressure at service valves to see once the kit is installed you might have to add a little more freon to bring super heat up—use gauges for pressure reading and amp probe for measuring amps.

5E Actual outdoor heat index.

6F Output air outside in shade is 115° F.

7G This is where the water line runs in and out by service valves. The opening for the refrigeration lines are large enough to run the outside dimensions of plastic tubing that comes in the kit.

8H This shows how the 30° difference in temperature takes place due to air passing through the cloud mist.

9I This is the air temperature once it has completed entry through cloud mist formed by spray orifices and is ready for entry into the condensing unit.

Figure 3A:
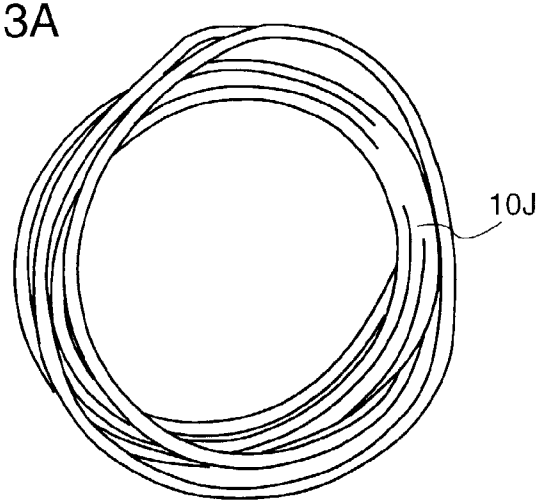

10J Shows the 25' roll of plastic tubing that also comes with kit. (FIG. 3A)

11K Shows three angles of how the water line is held in place and the alligator clip to mount to condensing unit. (FIG. 3B)

12L This is a plastic ferule and lock nut used to hook water line up after the valve is open. (FIG. 3C)

Figure 3E:
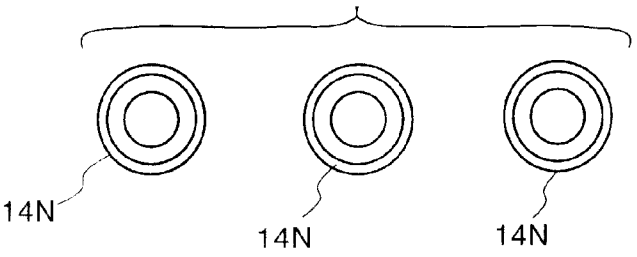
Figure 3G:
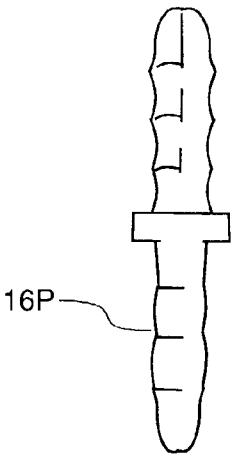
Figure 3D:
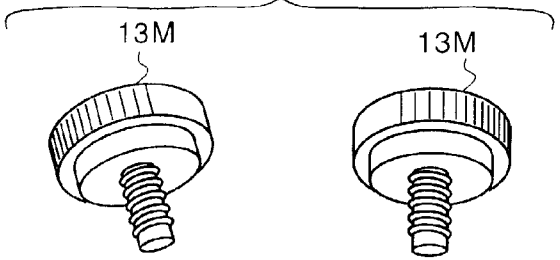

13M This shows the owner how the spray header screws into the plastic so it can be unscrewed and cleaned and remounted in case of calcium build-up. (FIG. 3D)

14N Shows the rubber seal around spray orifice (head on). (FIG. 3E)

Figure 3F:
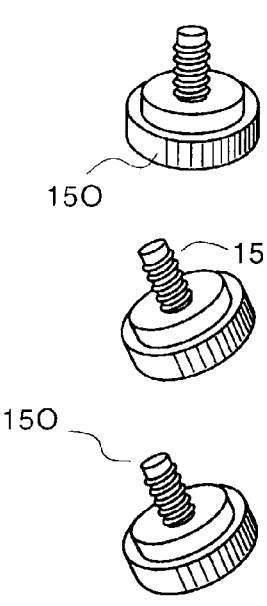

15O This shows a side view. It can be seen what screws into the tee and also the threads on the brass for removal or for tightening up spray orifice. (FIG. 3F)

16P This shows a connector, if the 25' roll of tubing is not enough, how you can add on by extending the length of the tubing (comes in plastic or brass). (FIG. 3G)

Figure 3I:
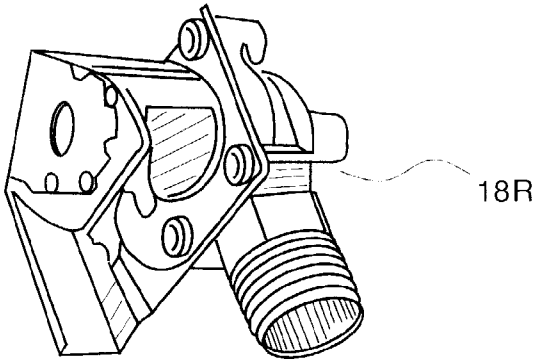
Figure 3K:
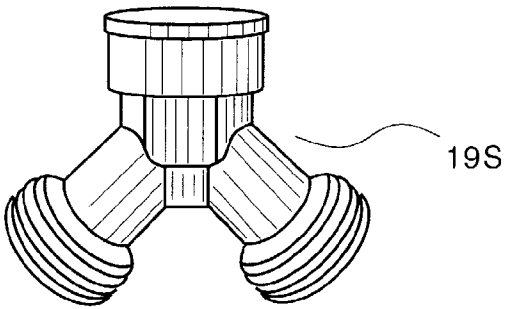
Figure 3H:
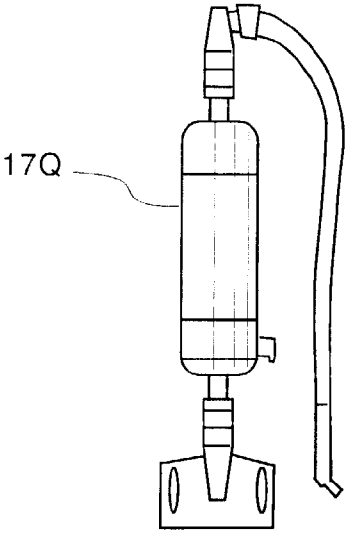
Figure 3J:
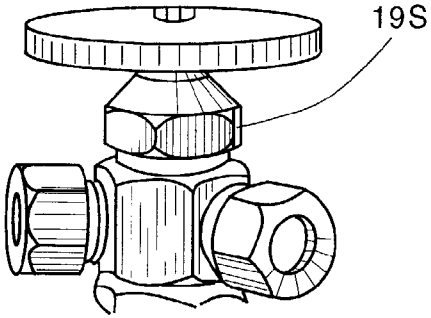

17Q This is an in-line filter you can buy at your hardware store if your water is really hard water (like from a well). (FIG. 3H)

18R Shows a magnetic water valve and a 115V coil as unit that operates off the air conditioning thermostat. One side of line voltage will go to back side of contactor when the thermostat calls for cooling, then other side of line will be picked up from the ground wire run to the unit. (FIG. 3I)

19S This shows that you can hook up this to your spigot for water supply and water your lawn at the same time. It comes with a water cut-off for both sides of supply. (FIGS. J and K)

While the invention has been described in relation to preferred embodiments of the invention, it will be appreciated that other embodiments, adaptations and modifications of the invention will be apparent to those skilled in the art.

What is claimed is:

1. A method of improving the efficiency of thermostat-controlled home air conditioning units having an external condensing unit coil and an air fan comprising:

affixing a plurality of mist-forming spray heads on said external condensing unit coil and connecting said mist-forming spray heads to a source of water under pressure, operating said mist-forming spray heads when the thermostat actuates so that an air cooling mist forms about twelve inches in the upstream direction away from the condensing unit coil so that the cooled air drawn through the condensing unit by the air fan is air cooled by said mist thereby improving the efficiency thereof.

2. A kit for improving the efficiency of the external condensing coil of a home air conditioning unit having a thermostat control device, an air fan for drawing ambient air through said condensing coil, and a housing for said condensing coil and said fan, comprising:

a plurality of misting heads and mounting clip devices for mounting said misting heads on said housing and oriented in the upstream direction to form a mist spaced at about twelve inches from said housing and pre-cool ambient air being drawn through said condensing coil by said air fan and avoid the tendency for water to collect and avoid rusting, and a solenoid valve connected to said thermostat control device for passing water to said plurality of misting heads only when said air fan is energized.

3. A method of improving the efficiency of thermostat-controlled home air conditioning units having an external condensing unit coil in which a fluid refrigerant flows and changes state, and an air fan draws ambient air through the unit to extract heat from said conditioning unit coil, comprising:

affixing a plurality of mist-forming spray heads on said external condensing unit coil housing and connecting said mist-forming spray heads to a source of water under pressure via a solenoid valve, operating said solenoid valve and said mist-forming spray heads when the thermostat actuates so that a mist is formed in an upstream direction spaced away from said condensing unit coil so that the cooled air causes fluid in the condensing unit coil to change state easier and faster, and whereby some super heat is removed from the ambient air prior to entering the condensing unit coil and thereby lower suction pressure and whereby flash gases returning on the suction side of the condenser condense back to liquid form much easier, thus lowering current drawn by the condensing unit and the air conditioning unit thereby reducing running time on the condensing unit and also on days which have extreme heat thereby allowing the unit to cycle on and off in synchronism with the thermostat, and whereby there is no pooling of water or water droplets retained within the condensing unit thereby avoiding the tendency of water to collect in condensing unit coil so that the condensing unit coil does not rust out.

* * * * *